US010641530B2

(12) United States Patent
Kihara et al.

(10) Patent No.: US 10,641,530 B2
(45) Date of Patent: May 5, 2020

(54) HEAT PUMP

(71) Applicant: Yanmar Co., Ltd., Osaka-shi, Osaka-fu (JP)

(72) Inventors: Hirotoshi Kihara, Osaka (JP); Keisuke Ota, Osaka (JP); Terunori Aikawa, Osaka (JP); Hirohiko Nobuhara, Osaka (JP); Hirotaka Nakamura, Osaka (JP)

(73) Assignee: YANMAR CO., LTD., Osaka (JP)

( * ) Notice: Subject to any disclaimer, the term of this patent is extended or adjusted under 35 U.S.C. 154(b) by 155 days.

(21) Appl. No.: 15/558,470

(22) PCT Filed: Mar. 11, 2016

(86) PCT No.: PCT/JP2016/057840
§ 371 (c)(1),
(2) Date: Sep. 14, 2017

(87) PCT Pub. No.: WO2016/148079
PCT Pub. Date: Sep. 22, 2016

(65) Prior Publication Data

US 2018/0051704 A1 Feb. 22, 2018

(30) Foreign Application Priority Data

Mar. 17, 2015 (JP) ..... 2015-053178

(51) Int. Cl.
*F25B 43/02* (2006.01)
*F25B 49/02* (2006.01)
(Continued)

(52) U.S. Cl.
CPC ..... *F25B 41/067* (2013.01); *F04D 27/009* (2013.01); *F25B 1/00* (2013.01);
(Continued)

(58) Field of Classification Search
CPC .. F04C 14/28; F04C 15/0092; F04C 2220/20; F04C 2270/18; F04D 27/009;
(Continued)

(56) References Cited

U.S. PATENT DOCUMENTS 4,926,651 A * 5/1990 Noguchi ..... B60H 1/3208 62/133
5,067,326 A * 11/1991 Alsenz ..... F25B 49/022 184/6.1
(Continued)

FOREIGN PATENT DOCUMENTS

JP 63-063659 U1 4/1988
JP 04-052466 A 2/1992
(Continued)

OTHER PUBLICATIONS

International Search Report dated Apr. 5, 2016 issued in corresponding PCT Application PCT/US2016/057840 cites the foreign patent documents above.

*Primary Examiner* — Devon C Kramer
*Assistant Examiner* — Christopher J Brunjes
(74) *Attorney, Agent, or Firm* — Norton Rose Fulbright US LLP

(57) ABSTRACT

An exemplary heat pump (10) includes: a compressor (16A, 16B) that discharges refrigerant; an oil separator (30) that separates oil from the refrigerant discharged from the compressor; an oil return channel (80) that returns the oil separated by the oil separator to the compressor; a pressure sensor (86A, 86B) that detects a pressure in the oil return channel; a first pressure loss member (84A, 84B) and a second pressure loss member (88A, 88B) disposed in portions of the oil return channel at an oil separator side and a compressor side relative to the pressure sensor; and a control device that increases an output of the compressor in a case
(Continued)

where a pressure detected by the pressure sensor exceeds a suction pressure of the compressor and less than a discharge pressure of the compressor.

20 Claims, 2 Drawing Sheets

(51) Int. Cl.
*F25B 31/00* (2006.01)
*F25B 41/06* (2006.01)
*F25B 1/00* (2006.01)
*F04D 27/00* (2006.01)

(52) U.S. Cl.
CPC ..... *F25B 31/004* (2013.01); *F25B 43/02* (2013.01); *F25B 49/02* (2013.01); *F25B 2500/27* (2013.01); *F25B 2600/025* (2013.01); *F25B 2600/2519* (2013.01); *F25B 2700/1932* (2013.01)

(58) Field of Classification Search
CPC ..... F25B 41/067; F25B 31/004; F25B 1/00; F25B 49/02; F25B 43/02; F25B 2600/2519; F25B 2600/025; F25B 2500/27; F25B 2700/1932; F16N 7/36; F04B 2205/01; F04B 2205/05; F04B 2205/061
See application file for complete search history.

(56) References Cited

U.S. PATENT DOCUMENTS 5,724,821 A * 3/1998 Lord ..... F04C 29/021 62/193
2012/0121440 A1* 5/2012 Powell ..... F04D 27/02 417/44.2

FOREIGN PATENT DOCUMENTS

JP 11107966 A * 4/1999 ..... F25B 31/004
JP 2012-82992 A 4/2012
JP 2014-115062 A 6/2014

* cited by examiner

HEAT PUMP

CROSS REFERENCES TO RELATED APPLICATIONS

This application is a national stage application pursuant to 35 U.S.C. § 371 of International Application No. PCT/JP2016/057840, filed on Mar. 11, 2016, which claims priority under 35 U.S.C. § 119 to Japanese Patent Application No. 2015-053178, filed on Mar. 17, 2015, the disclosures of which are hereby incorporated by reference in their entireties.

TECHNICAL FIELD

The present invention relates to a heat pump.

BACKGROUND ART

In a heat pump that has been known to date, an oil separator collects refrigerating machine oil (oil) included in refrigerant discharged from a compressor and the collected oil is returned to the compressor. For example, a heat pump described in Patent Literature 1 (PTL 1) includes an oil return channel for returning oil collected by an oil separator to a compressor. The oil return channel includes a shut-off valve and a capillary. The oil return channel is provided with a pressure sensor that detects an oil pressure in a portion of the oil return channel at an oil separator side relative to the capillary. The heat pump described in PTL 1 is configured to detect an abnormality of the oil return channel such as breakage or clogging by comparing the pressure detected by the pressure sensor with a discharge pressure or a suction pressure of the compressor.

CITATION LIST

Patent Literature

PTL 1: Japanese Patent Application Laid-Open No. 2012-82992

SUMMARY OF INVENTION

Technical Problem

In the heat pump described in PTL 1, however, the pressure sensor can detect a pressure near the discharge pressure of the compressor both when oil normally flows in the oil return channel and when the capillary is clogged. This leads to a low accuracy in detecting an abnormality of the oil return channel.

Instead, detection of an abnormality of the oil return channel is carried out based on a comparison between the temperature of oil in the oil return channel and the discharge temperature of the compressor. If the temperature of oil in the oil return channel is near the discharge temperature of the compressor, the oil return channel is determined to be normal.

In this case, however, if a large amount of oil is stored in the oil separator at start-up of the heat pump, it takes time for the oil temperature in the oil return channel to reach a temperature near the discharge temperature of the compressor. Thus, for a while after the start-up of the heat pump, the oil return channel is determined to be abnormal, although oil normally flows in the oil return channel. Thus, for a while after the start-up of the heat pump, abnormality determination of the oil return channel cannot be performed.

In another known heat pump, a plurality of compressors are provided, and refrigerant streams discharged from the compressors are merged, and from the merged refrigerant, oil is collected by one oil separator. In this case, an oil return channel starts from the oil separator and is branched into a plurality of paths that are individually connected to the compressors. Each of the branch paths is provided with a shut-off valve and a temperature sensor. In this configuration, an abnormality of the oil return channel is detected based on a difference in oil temperature between the branch paths of the oil return channel.

For example, in a configuration in which two compressors are provided and the oil return channel is branched into two paths, an abnormality of the oil return channel is detected base on the difference in oil temperature between the two branch paths. For example, while only one of the compressors operates, that is, while the shut-off valve on the branch path connected to the nonoperating compressor is closed and the shut-off valve on the branch path connected to the operating compressor is open, a temperature difference occurs between oil in the two branch paths. At this time, if no temperature difference occurs, there is an abnormality that the shut-off valve corresponding to the nonoperating compressor is not normally closed or the shut-off valve corresponding to the operating compressor is not normally open.

It should be noted that residual heat of the compressor immediately after stopping its operation prevents the temperature of oil near this compressor from decreasing immediately. Thus, in a case where temperature sensors are disposed on portions of branch paths near the compressors, no temperature difference occurs for a while between the temperature detected by the temperature sensor corresponding to the operating compressor and the temperature detected by the temperature sensor corresponding to the compressor immediately after stopping its operation. Accordingly, determination of an abnormality of the oil return channel cannot be performed for a while after one of the compressors stops.

It is therefore an object of an aspect of the present invention to accurately detect an abnormality of an oil return channel at an early stage in a heat pump in which oil in refrigerant discharged from a compressor is collected by an oil separator and the collected oil is returned to the compressor by using the oil return channel.

Solution to Problem

To solve the technical problems described above, an aspect of the present invention provides a heat pump including:

a compressor that compresses refrigerant and discharges the compressed refrigerant;

an oil separator that separates oil from the refrigerant discharged from the compressor;

an oil return channel that returns oil separated by the oil separator to the compressor;

a pressure sensor that detects a pressure in the oil return channel; and first and second pressure loss members disposed in portions of the oil return channel at an oil separator side and a compressor side relative to the pressure sensor; and a control device that controls the compressor to increase an output of the compressor if a pressure detected by the pressure sensor exceeds a suction pressure of the compressor and less than a discharge pressure of the compressor.

Advantageous Effects of Invention

According to an aspect of the present invention, in a heat pump in which oil in refrigerant discharged from a compressor is collected by an oil separator and the collected oil is returned to the compressor by using an oil return channel, an abnormality of the oil return channel can be accurately detected at an early stage.

DESCRIPTION OF EMBODIMENT

An embodiment of the present invention will be described hereinafter with reference to the drawings.

Figure 1:
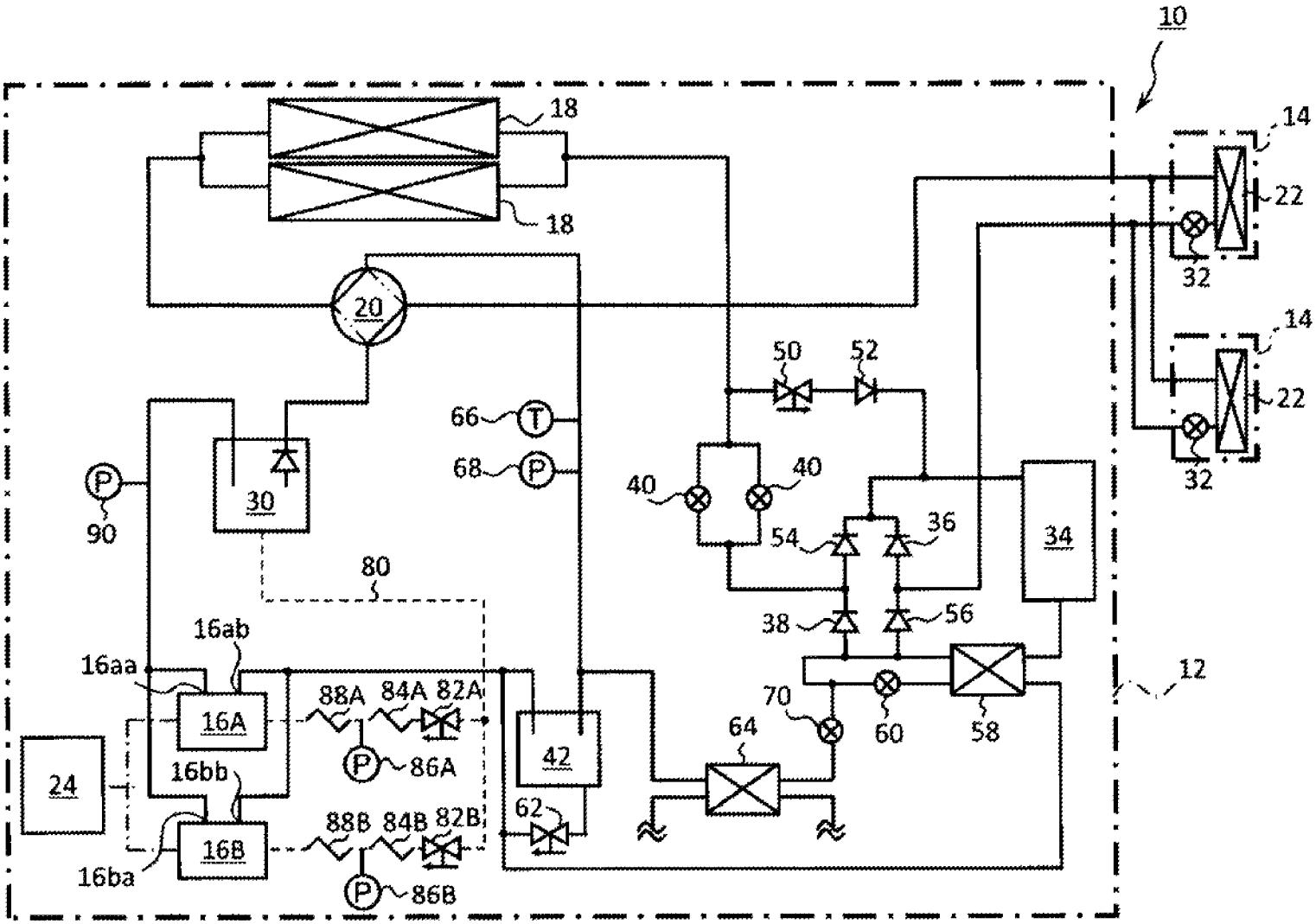
FIG. 1 A circuit diagram illustrating a configuration of a heat pump according to an embodiment of the present invention.

FIG. 1 is a circuit diagram illustrating a configuration of a heat pump according to an embodiment of the present invention. In this embodiment, the heat pump is a heat pump incorporated in an air conditioner. In FIG. 1, a solid line indicates a refrigerant channel (refrigerant pipe) in which refrigerant flows, and a broken line indicates an oil channel (oil pipe) in which refrigerating machine oil (oil) flows. In the circuit diagram illustrated in FIG. 1, components of the heat pump, such as a filter, are not shown for simplicity of description.

As illustrated in FIG. 1, a heat pump 10 includes an outdoor unit 12 that exchanges heat with outdoor air and at least one indoor unit 14 that exchanges heat with indoor air. In this embodiment, the heat pump 10 includes two indoor units 14.

The outdoor unit 12 includes compressors 16A and 16B that compress refrigerant and discharge the compressed refrigerant, heat exchangers 18 that perform heat exchange between refrigerant and outdoor air, and a four-way valve 20. Each of the indoor units 14 includes a heat exchanger 22 that performs heat exchange between refrigerant and indoor air.

The compressors 16A and 16B are driven by a gas engine 24. In this embodiment, the two compressors 16A and 16B and the one gas engine 24 are mounted in the outdoor unit 12. At least one of the compressors 16A and 16B is selectively driven by one gas engine 24. The driving source of the compressors 16A and 16B is not limited to the gas engine 24, and may be a motor or a gasoline engine, for example.

High-temperature and high-pressure gas refrigerant discharged from at least one of discharge ports 16*aa* and 16*ba* of the compressors 16A and 16B is directed to the heat exchangers 18 of the outdoor unit 12 or the heat exchangers 22 of the indoor units 14 by the four-way valve 20. In a heating operation, the gas refrigerant discharged from the compressors 16A and 16B is sent to the heat exchangers 22 of the indoor units 14. On the other hand, in a cooling operation, the gas refrigerant is sent to the heat exchangers 18 of the outdoor unit 12.

An oil separator 30 that separates oil included in refrigerant is disposed on a discharge path from the compressors 16A and 16B, that is, on a refrigerant channel between the discharge ports 16*aa* and 16*ba* of the compressors 16A and 16B and the four-way valve 20.

In the heating operation, the high-temperature and high-pressure gas refrigerant that is discharged from at least one of the compressors 16A and 16B and has passed through the four-way valve 20 (solid line) exchanges heat with indoor air in the heat exchanger 22 of at least one of the indoor units 14. That is, heat is transferred from the refrigerant to the indoor air through the heat exchanger 22. Consequently, the refrigerant becomes a low-temperature and high-pressure liquid state.

Each of the indoor units 14 includes an expansion valve 32 whose opening degree is adjustable. The expansion valve 32 is disposed in the indoor unit 14 and is located between the heat exchanger 22 of the indoor unit 14 and the heat exchangers 18 of the outdoor unit 12 on the refrigerant channel. While the expansion valve 32 is open, refrigerant can pass through the heat exchanger 22 of the indoor unit 14. While the indoor unit 14 stops, the expansion valve 32 is closed. In the heating operation, the expansion valve 32 is fully open.

The outdoor unit 12 includes a receiver 34. The receiver 34 is a buffer tank that temporarily stores low-temperature and high-pressure liquid refrigerant subjected to heat exchange with indoor air in the heat exchangers 22 of the indoor units 14 in the heating operation. The liquid refrigerant that has flowed from the heat exchangers 22 of the indoor units 14 flows into the receiver 34 through a check valve 36.

In the heating operation, the low-temperature and high-pressure liquid refrigerant in the receiver 34 is sent to the heat exchangers 18 of the outdoor unit 12. A check valve 38 and expansion valves 40 are provided on the refrigerant channel between the receiver 34 and the heat exchangers 18. The expansion valves 40 are expansion valves whose opening degrees are adjustable. In the heating operation, the opening degrees of the expansion valves 40 are adjusted in such a manner that the refrigerant superheating degree of a suction port 16*ab* or 16*bb* of the compressor 16A or 16B is a predetermined temperature or more. The refrigerant superheating degree of the suction port 16*ab* or 16*bb* is a difference between a saturated steam temperature determined from a pressure detected by a pressure sensor 68 and a temperature detected by a temperature sensor 66, and is controlled in such a manner that the detected temperature is higher than the saturated stem temperature by a predetermined temperature (e.g., 5° C.) or more. The low-temperature and high-pressure liquid refrigerant that has flowed from the receiver 34 is expanded (subjected to pressure reduction) by the expansion valves 40 to be a low-temperature and low-pressure liquid state (mist state). The refrigerant superheating degree may be calculated by using a temperature detected by an (unillustrated) temperature sensor disposed on the refrigerant path downstream of a merging point with refrigerant that has passed through an evaporation assisting heat exchanger 64, instead of the temperature detected by the temperature sensor 66, depending on the operating state.

In the heating operation, the low-temperature and low-pressure liquid refrigerant that has passed through the expansion valves 40 exchanges heat with outdoor air in the heat exchangers 18 of the outdoor unit 12. That is, heat is transferred from the outdoor air to the refrigerant through the heat exchangers 18. Consequently, the refrigerant becomes a low-temperature and low-pressure gas state.

The outdoor unit 12 also includes an accumulator 42. In the heating operation, the accumulator 42 temporarily stores the low-temperature and low-pressure gas refrigerant subjected to heat exchange with outdoor air in the heat exchangers 18 of the outdoor unit 12. The accumulator 42 is disposed on a suction path of the compressors 16A and 16B (refrigerant channel between the suction ports 16*ab* and 16*bb* of the compressors 16A and 16B and the four-way valve 20).

The low-temperature and low-pressure gas refrigerant in the accumulator 42 is sucked in at least one of the compressors 16A and 16B and is compressed therein. Consequently, the refrigerant becomes a high-temperature and high-pressure gas state, and in the heating operation, is sent to the heat exchangers 22 of the indoor units 14 again.

Since only the gas refrigerant is generally caused to flow into the accumulator 42 by controlling the opening degree of the expansion valves 40 or the expansion valve 32 described later, a shut-off valve 62 is open in a normal air-conditioning operation. The shut-off valve 62 is closed in a period in which liquid refrigerant is present because of a rapid decrease of an air-conditioning load, such as a non-operating period or an initial stage of start-up, and thereby, the liquid refrigerant is stored in the accumulator 42.

The heat pump 10 also includes the evaporation assisting heat exchanger 64 disposed in parallel with the heat exchangers 18 in a refrigerant flow in the heating operation.

In a case where the refrigerant superheating degree of the suction port 16*ab* or 16*bb* does not increase to the predetermined temperature or more only by heat exchange of the heat exchangers 18, such as a case where the outdoor air temperature is less than 0° C., liquid refrigerant in the receiver 34 is caused to flow to the evaporation assisting heat exchanger 64. To cause the refrigerant to flow in this direction, an expansion valve 70 whose opening degree is adjustable is disposed between the receiver 34 and the evaporation assisting heat exchanger 64.

A control device (not shown) of the heat pump 10 opens the expansion valve 70 if the refrigerant superheating degree of the suction port 16*ab* or 16*bb* is the predetermined temperature or less.

When the expansion valve 70 is opened, at least a part of the liquid refrigerant flows from the receiver 34 toward the evaporation assisting heat exchanger 64 through the expansion valve 70 to be a low-temperature and low-pressure mist state.

The mist refrigerant that has passed through the expansion valve 70 is heated in the evaporation assisting heat exchanger 64 by, for example, a high-temperature exhaust gas or cooling water of the gas engine 24 (i.e., waste heat of the gas engine 24). In this manner, the mist refrigerant that has flowed into the evaporation assisting heat exchanger 64 through the expansion valve 70 is changed to a high-temperature and low-pressure gas state. The high-temperature gas refrigerant heated by the evaporation assisting heat exchanger 64 comes to have a superheating degree higher than that of refrigerant that has passed through the heat exchangers 18, and is merged with the refrigerant channel between the four-way valve 20 and the accumulator 42. In this manner, liquid refrigerant included in the gas refrigerant that has passed through the four-way valve 20 and returns to the compressors 16 is heated by the high-temperature gas refrigerant from the evaporation assisting heat exchanger 64 and is evaporated (gasified). As a result, refrigerant flowing into the accumulator 42 is substantially caused to be in a gas state.

On the other hand, in a cooling operation, high-temperature and high-pressure gas refrigerant discharged from at least one of the compressors 16A and 16B moves to the heat exchangers 18 of the outdoor unit 12 through the four-way valve 20 (indicated by chain double-dashed lines). Through heat exchange with outdoor air in the heat exchangers 18, the gas refrigerant becomes a low-temperature and high-pressure liquid state.

The refrigerant that has flowed from the heat exchangers 18 passes through a shut-off valve 50 and a check valve 52 and flows into the receiver 34. The shut-off valve 50 is closed in the heating operation.

In the cooling operation, the refrigerant that has flowed from the heat exchangers 18 flows into the receiver 34 only through the shut-off valve 50 and the check valve 52, and in some cases, additionally through the expansion valves 40 and a check valve 54.

In the cooling operation, the refrigerant that has flowed into the receiver 34 passes through a check valve 56 and then passes through the expansion valves 32 of the indoor units 14. By the passage through the expansion valves 32, the refrigerant is subjected to pressure reduction and becomes a low-temperature and low-pressure liquid state (mist state).

The refrigerant that has passed through the expansion valves 32 passes through the heat exchangers 22 of the indoor units 14 and exchanges heat with indoor air therein. In this manner, the refrigerant takes heat from the indoor air (cools the indoor air). As a result, the refrigerant becomes a low-temperature and low-pressure gas state. The refrigerant that has flowed from the heat exchangers 22 passes through the four-way valve 20 and the accumulator 42, and returns to at least one of the compressors 16A and 16B.

To increase a cooling efficiency, the heat pump 10 includes a cooling heat exchanger 58 for cooling refrigerant flowing from the receiver 34 toward the check valve 56.

The cooling heat exchanger 58 is configured to perform heat exchange between the liquid refrigerant flowing from the receiver 34 toward the check valve 56 and mist refrigerant, that is, to cool the liquid refrigerant by mist refrigerant. This mist refrigerant is obtained by changing part of the liquid refrigerant flowing from the cooling heat exchanger 58 toward the check valve 56 into mist (reducing the pressure of the refrigerant) by using an expansion valve 60. The expansion valve 60 is a valve whose opening degree is adjustable in order to selectively cool liquid refrigerant with the cooling heat exchanger 58.

When the expansion valve 60 is at least partially opened by control of the expansion valve 60 by the control device (not shown) of the heat pump 10, part of liquid yet to pass through the check valve 56 after the cooling heat exchanger 58 passes through the expansion valve 60 to be changed into mist (subjected to pressure reduction). The mist refrigerant obtained by the expansion valve 60 flows into the cooling heat exchanger 58, takes heat from the liquid refrigerant that has flowed out of the receiver 34 and yet to pass through the check valve 56, and is thereby gasified. As a result, liquid refrigerant at a temperature lower than that in a state where the expansion valve 60 is closed, flows into the heat exchangers 22 of the indoor units 14.

On the other hand, the gas refrigerant that has taken heat from the liquid refrigerant that has flowed out of the receiver 34 and yet to pass through the check valve 56, is directly returned to the compressors 16A and 16B from the cooling heat exchanger 58. This gas refrigerant is used for evaporating liquid refrigerant stored in the accumulator 42. That is, by opening the shut-off valve 62, the liquid refrigerant in the accumulator 42 is mixed with gas refrigerant returning from the cooling heat exchanger 58 to the compressors 16A and 16B to be gasified, and is returned to the compressors 16A and 16B.

The foregoing description is schematically directed to components of the heat pump 10 related to refrigerant. Now, a configuration of the heat pump 10 related to oil will be described with reference to FIG. 2.

As described above, the oil separator 30 separates (collects) oil from refrigerant discharged from at least one of the compressors 16A and 16B. The oil collected by the oil separator 30 is returned to the compressors 16A and 16B through an oil return channel 80. For example, oil is directly returned to oil reservoirs of the compressors 16A and 16B or is returned while being mixed in refrigerant flowing into the suction ports 16*ab* and 16*bb* of the compressors 16A and 16B.

In this embodiment, the heat pump 10 includes the two compressors 16A and 16B. Thus, the oil return channel 80 is branched into a branch path 80A connected to the compressor 16A and a branch path 80B connected to the compressor 16B.

The branch path 80A of the oil return channel 80 connected to the compressor 16A is provided with a shut-off valve 82A, a capillary 84A, a pressure sensor 86A, and a capillary 88A in this order from the oil separator 30. On the other hand, the branch path 80B of the oil return channel 80 connected to the compressor 16B is provided with a shut-off valve 82B, a capillary 84B, a pressure sensor 86B, and a capillary 88B in this order from the oil separator 30.

Each of the shut-off valves 82A and 82B is kept open while the corresponding one of the compressors 16A and 16B is operating, and is kept closed while the corresponding one of the compressors 16A and 16B is stopped. In this manner, an appropriate amount of oil is supplied only to the operating compressor.

The capillaries 84A, 84B, 88A, and 88B are pressure loss members that reduce the pressure of oil returning from the oil separator 30 to the compressors 16A and 16B. That is, the capillaries 84A, 84B, 88A, and 88B reduce the pressure of oil flowing in the oil return channel 80 under a pressure substantially equal to the discharge pressure of the compressors 16A and 16B. As long as a pressure loss occurs, the capillaries may be replaced by, for example, expansion valves.

The pressure sensors 86A and 86B detect the pressure of oil in the corresponding branch paths 80A and 80B of the oil return channel 80. Based on the pressures detected by the pressure sensors 86A and 86B, the control device of the heat pump 10 detects an abnormality of the oil return channel 80. A method for detecting an abnormality of the oil return channel 80 will be described.

Figure 2:
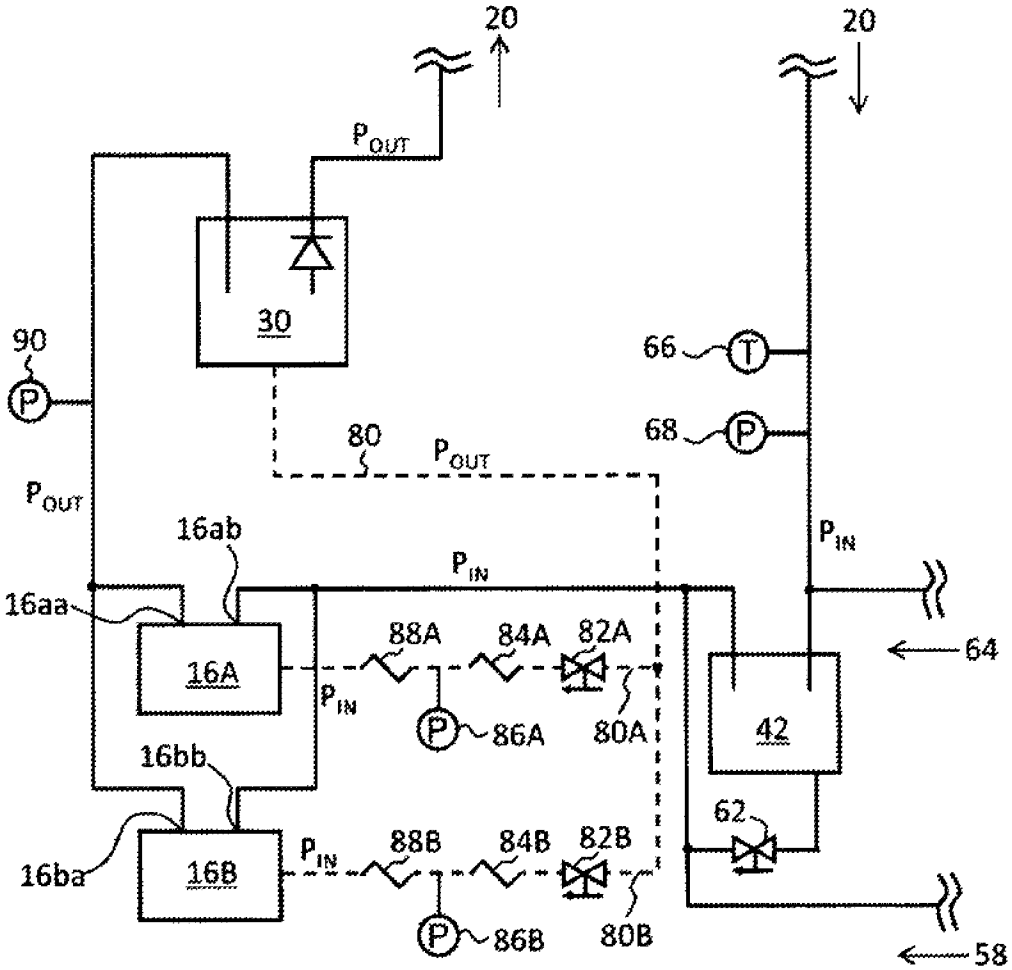
FIG. 2 A circuit diagram illustrating a vicinity of an oil return channel.

As illustrated in FIG. 2, the pressure sensor 86A detects the pressure of oil in a portion of the branch path 80A between the capillaries 84A and 88A. Similarly, the pressure sensor 86B detects the pressure of oil in a portion of the branch path 80B between the capillaries 84B and 88B.

In a case where the compressors 16A and 16B are operating and no abnormality occurs in the oil return channel 80, the pressure in a portion of the oil return channel 80 upstream of the capillaries 84A and 84B (a portion between the capillaries 84A and 84B and the oil separator 30) is substantially equal to a discharge pressure $P_{OUT}$ of the compressors 16A and 16B.

On the other hand, in the case where the compressors 16A and 16B are operating and no abnormality occurs in the oil return channel 80, the pressure in a portion of the oil return channel 80 downstream of the capillaries 88A and 88B (a portion of the branch path 80A between the capillary 88A and the compressor 16A and a portion of the branch path 80B between the capillary 88B and the compressor 16B) is substantially equal to a suction pressure $P_{IN}$ of the compressors 16A and 16B.

Thus, in the case where the compressors 16A and 16B are operating and no abnormality occurs in the oil return channel 80 (i.e., the oil return channel 80 is normal), the pressure sensors 86A and 86B detect a normal pressure value $P_N$ greater than the suction pressure $P_{IN}$ of the compressors 16A and 16B and less than the discharge pressure $P_{OUT}$ of the compressors 16A and 16B. Specifically, the pressure sensors 86A and 86B detect the normal pressure value $P_N$ based on pressure losses of the capillaries 84A, 84B, 88A, and 88B.

For example, in a case where the capillaries 84A, 84B, 88A, and 88B have the same configuration, the normal pressure value $P_N$ detected by the pressure sensors 86A and 86B when the oil return channel 80 is normal is substantially an intermediate value between the discharge pressure $P_{OUT}$ and the suction pressure $P_{IN}$ of the compressors 16A and 16B.

In a case where pressure losses of the capillaries 84A and 84B at the oil separator 30 side are larger than pressure losses of the capillaries 88A and 88B at the compressors 16A and 16B side, for example, the normal pressure value $P_N$ detected by the pressure sensors 86A and 86B when the oil return channel 80 is normal is near the suction pressure $P_{IN}$.

In a case where the pressure detected by at least of one of the pressure sensors 86A and 86B is not the normal pressure value $P_N$ but near the discharge pressure $P_{OUT}$ or the suction pressure $P_{IN}$, this detection result suggests the possibility of occurrence of an abnormality in the oil return channel 80.

For example, in a case where the capillary 88A is clogged, the pressure sensor 86A detects a pressure substantially equal to the discharge pressure $P_{OUT}$ of the compressors 16A and 16B. In a case where the capillary 84B is clogged or the shut-off valve 82B is not open, for example, the pressure sensor 86B detects a pressure substantially equal to the suction pressure $P_{IN}$ of the compressors 16A and 16B.

Thus, based on the pressures detected by the pressure sensors 86A and 86B, not only detection of normality or abnormality of the oil return channel 80 but also specification to some degree of a reason of a possible abnormality can be performed.

The discharge pressure $P_{OUT}$ of the compressors 16A and 16B is determined by a pressure sensor 90 that detects a pressure in the refrigerant channel between the discharge ports 16*aa* and 16*ba* of the compressors 16A and 16B and the oil separator 30.

On the other hand, the suction pressure $P_{IN}$ of the compressors 16A and 16B is determined by the pressure sensor 68 that detects a pressure in the refrigerant channel between the four-way valve 20 and the accumulator 42.

The control device of the heat pump 10 determines whether an abnormality occurs in the oil return channel 80 or not, based on the pressures detected by the pressure sensors 86A and 86B. That is, the control device determines whether the pressures detected by the pressure sensors 86A and 86B exceed the suction pressure $P_{IN}$ of the compressors 16A and 16B and less than the discharge pressure $P_{OUT}$ of the compressors 16A and 16B.

If the oil return channel 80 is normal (i.e., if the pressures detected by the pressure sensors 86A and 86B exceed the suction pressure $P_{IN}$ of the compressors 16A and 16B and less than the discharge pressure $P_{OUT}$ of the compressors 16A and 16B), the control device of the heat pump 10 increases the outputs of the compressors 16A and 16B (permits an increase in outputs) as necessary.

On the other hand, while an abnormality of the oil return channel 80 is detected (i.e., if the pressures detected by the pressure sensors 86A and 86B neither exceed the suction pressure $P_{IN}$ of the compressors 16A and 16B nor are less than the discharge pressure $P_{OUT}$ of the compressors 16A and 16B), the control device of the heat pump 10 restricts an increase in the outputs of the compressors 16A and 16B and maintains operation of the compressors 16A and 16B. When detection of an abnormality continues for a predetermined time or longer, the control device stops the compressors 16A and 16B and issues a notification of an abnormality of the oil return channel 80 as a warning.

In the foregoing embodiment, in the heat pump 10 in which oil in refrigerant discharged from the compressors 16A and 16B is collected by the oil separator 30 and the collected oil is returned to the compressors 16A and 16B by using the oil return channel 80, an abnormality of the oil return channel 80 can be accurately detected at an early stage.

That is, as described above, since an abnormality of the oil return channel 80 is detected based on the pressure of oil in the oil return channel 80, the abnormality of the oil return channel 80 can be accurately detected at an early stage, as compared to a case where the abnormality is detected based on an oil temperature.

The present invention has been described using the embodiment, but is not limited to the embodiment described above.

For example, although the heat pump 10 includes the two compressors 16A and 16B in the embodiment, the present invention is not limited to this example. For example, the heat pump may include one compressor. In this case, the shut-off valve on the oil return channel can be omitted. That is, if a plurality of compressors are provided, a shut-off valve is needed for selectively returning oil to an operating compressor. However, since only one compressor is provided in this case, no shut-off valve is needed.

In addition, in the embodiment, for example, the heat pump 10 is an air conditioner that controls the temperature of indoor air as a target of temperature adjustment, but the embodiment of the present invention is not limited to this example. The heat pump according to the embodiment of the present invention may be a chiller for adjusting the temperature of water using refrigerant. That is, the heat pump according to an aspect of the present invention broadly includes: a compressor that compresses refrigerant and discharges the compressed refrigerant; an oil separator that separates oil from the refrigerant discharged from the compressor; an oil return channel that returns the oil separated by the oil separator to the compressor; a pressure sensor that detects a pressure in the oil return channel; first and second pressure loss members disposed in portions of the oil return channel at an oil separator side and a compressor side relative to the pressure sensor; and a control device that controls the compressor to increase an output of the compressor in a case where a pressure detected by the pressure sensor exceeds a suction pressure of the compressor and less than a discharge pressure of the compressor.

The present invention is applicable to a heat pump including an oil separator that collects oil included in refrigerant discharged from a compressor and returns the collected oil to the compressor.

The present disclosure has been fully described in relation to a preferred embodiment with reference to the accompanying drawings, but it is obvious for those skilled in the art to which the present invention pertains that various modifications and changes are possible. Such modifications and changes, unless they depart from the scope of the present invention as set forth in a claim attached hereto, shall be understood as to be encompassed by the present invention.

The disclosed contents of the specification, drawings, and claim of Japanese Patent Application Laid-Open No. 2015-53178 filed on Mar. 17, 2015 are incorporated herein by reference in its entirety.

REFERENCE SIGNS LIST

10 heat pump
16 compressor
30 oil separator
80 oil return channel
84A first pressure loss member (capillary)
84B first pressure loss member (capillary)
86A pressure sensor
86B pressure sensor
88A second pressure loss member (capillary)
88B second pressure loss member (capillary)

The invention claimed is:

1. A heat pump comprising:

a compressor configured to compress and discharge a refrigerant;

an oil separator configured to separate an oil from the refrigerant discharged from the compressor;

an oil return channel configured to return the oil separated by the oil separator to the compressor;

a pressure sensor configured to detect a pressure in the oil return channel;

a first capillary disposed in a first portion of the oil return channel on an oil separator side of the pressure sensor, and a second capillary disposed in a second portion of the oil return channel on a compressor side of the pressure sensor;

a shut-off valve disposed in a third portion of the oil return channel on the oil separator side of the first capillary, the shut-off valve being kept open while the compressor is operating and kept closed while the compressor is stopped; and a control device configured to permit an increase in output of the compressor when a pressure detected by the pressure sensor exceeds a suction pressure of the compressor and is less than a discharge pressure of the compressor.

2. A heat pump comprising:

a first compressor configured to compress a refrigerant and discharge the compressed refrigerant;

an oil separator configured to separate an oil from the compressed refrigerant discharged from the first compressor;

an oil return channel configured to return the oil separated by the oil separator to the first compressor;

a first pressure sensor configured to detect a pressure at a first location in the oil return channel;

first and second means for decreasing pressure disposed in or defining portions of the oil return channel, wherein:

the first means for decreasing pressure is upstream of the first location; and the second means for decreasing pressure is downstream of the first location; and a first shut-off valve configured to selectively block fluid communication between the oil separator and the first means for decreasing pressure.

3. The heat pump of claim 2, wherein the first and second means for decreasing pressure comprises a first capillary and a second capillary, and further comprising:

a third capillary and a fourth capillary, each of the third capillary and the fourth capillary disposed in or defining portions of the oil return channel;

wherein:

the third capillary is upstream of a second location in a second flow path; and the fourth capillary is downstream of the second location in the second flow path.

4. The heat pump of claim 3, further comprising a second pressure sensor configured to detect a pressure at the second location in the oil return channel.

5. The heat pump of claim 4, further comprising a second shut-off valve configured to selectively block fluid communication between the oil separator and the second capillary.

6. The heat pump of claim 5, wherein:

the oil return channel defines:

a first oil return path; and a second oil return path;

the first pressure sensor, the first shut-off valve, the first location, the first capillary, and the second capillary are disposed along the first oil return path; and the second pressure sensor, the second shut-off valve, the second location, the third capillary, and the fourth capillary are disposed along the second oil return path.

7. The heat pump of claim 6, wherein:

the first oil return path is coupled to the first compressor and defines a first flow path from the oil return channel, to the first shut-off valve, through the first capillary, through the first pressure sensor, through the second capillary, to the first compressor; and the second oil return path is coupled to a second compressor and defines the second flow path from the oil return channel to the second shut-off valve, through the third capillary, through the second pressure sensor, through the fourth capillary, to the second compressor.

8. The heat pump of claim 7, further comprising a control device configured to control the first compressor to increase an output of the first compressor based on the pressure detected by the first pressure sensor being greater than a suction pressure of the first compressor and less than a discharge pressure of the first compressor.

9. The heat pump of claim 8, wherein the control device is configured to:

based on the first compressor being in an operating state, open the first shut off valve; and based on the first compressor being in a stopped state, close the first shut off valve.

10. The heat pump of claim 9, wherein the control device is configured to:

based on either the pressure detected by the first pressure sensor being less than the suction pressure of the first compressor or greater than the discharge pressure of the first compressor for a predetermined time:

stop the output of the first compressor; and transmit a signal.

11. The heat pump of claim 2, further comprising:

a means for controlling configured to:

receive a signal indicative of the pressure detected by the first pressure sensor; and based on a determination that the pressure detected by the first pressure sensor is within a first pressure range, increase an output of the first compressor.

12. The heat pump of claim 11, wherein the first pressure range is greater than or equal to a suction pressure of the first compressor and less than or equal to a discharge pressure of the first compressor.

13. The heat pump of claim 12, wherein the heat pump defines a first flow path from the first compressor, to the oil separator, to the oil return channel, to the first shut-off valve, to the first means for decreasing pressure, to the first pressure sensor, to the second means for decreasing pressure, to the first compressor.

14. The heat pump of claim 13, wherein the means for controlling is configured to:

based on the first compressor being in an operating state, open the first shut off valve; and based on the first compressor being in a stopped state, close the first shut off valve.

15. The heat pump of claim 14, further comprising:

a second pressure sensor configured to detect a pressure at a second location in the oil return channel;

a third and fourth means for decreasing pressure disposed in or defining portions of the oil return channel, wherein:

the third means for decreasing pressure is upstream of the second location; and the fourth means for decreasing pressure is downstream of the second location; and a second shut-off valve configured to selectively block fluid communication between the oil separator and the third means for decreasing pressure.

16. The heat pump of claim 15, wherein the means for controlling is configured to:

detect the pressure at the second pressure sensor; and based on a determination that each of the first pressure sensor and second pressure sensor is within the first pressure range, increase the output of the first compressor.

17. The heat pump of claim 16, wherein the means for controlling is further configured to:

based on either the first pressure sensor or second pressure sensor being outside of the first pressure range, maintain the output of the first compressor.

18. The heat pump of claim 17, wherein the means for controlling is further configured to, based on either the first pressure sensor or second pressure sensor being outside the first pressure range for a predetermined time:

stop the output of the first compressor; and transmit a notification.

19. The heat pump of claim 18, wherein:

the heat pump defines a second flow path from the oil separator, to the oil return channel, to the second shut-off valve, to the third means for decreasing pressure, to the second pressure sensor, to the fourth means for decreasing pressure.

20. A method of operating a heat pump, the method comprising:

at the heat pump comprising a compressor, an oil separator, an oil return channel, a pressure sensor, a first capillary upstream of the pressure sensor in a flow path and a second capillary downstream of the pressure sensor in the flow path, and a shut-off between the oil separator and the first capillary, performing:

compressing a refrigerant by the compressor;

separating an oil from the compressed refrigerant by the oil separator;

supplying the oil from the oil separator to the compressor via the oil return channel;

detecting a pressure of the oil at a first location in the oil return channel;

decreasing the pressure of the oil at a location upstream of the first location of the oil return channel;

decreasing the pressure of the oil at a location downstream of the first location of the oil return channel; and increasing an output of the compressor based on the pressure of the oil detected at the first location being within a first pressure range.

* * * * *